US005857279A

United States Patent [19]

de Oliveira Masina

[11] Patent Number: 5,857,279

[45] Date of Patent: Jan. 12, 1999

[54] ERGONOMICALLY DEFORMABLE GRIP FOR SPECIAL USE IN FIREARMS

[75] Inventor: Ezio Renato de Oliveira Masina, Porto Alegre, Brazil

[73] Assignee: Forjas Taurus S/A, Porto Alegre-RS, Brazil

[21] Appl. No.: 620,987

[22] Filed: Mar. 22, 1996

[30] Foreign Application Priority Data

Mar. 24, 1995 [BR] Brazil ..... 9500976

[51] Int. Cl.[6] ..... F41C 23/00

[52] U.S. Cl. ..... 42/71.01; 42/71.02; 42/74

[58] Field of Search ..... 42/71.01, 71.02, 42/72, 74

[56] References Cited

U.S. PATENT DOCUMENTS 4,286,401 9/1981 Pachmayr et al. ..... 42/71.01

4,551,937 11/1985 Seehase ..... 42/74

4,638,582 1/1987 Farrar ..... 42/71.01

*Primary Examiner*—J. Woodrow Eldred

[57] ABSTRACT

An ergonomically deformable grip for special use in firearms is provided. The grip is made of elastomeric material so as to obtain a basic contour at the front of the grip through a series of projections formed from the elastic material. The projections can be similar to thin ribs separated among themselves by narrow empty spaces, over which the fingers of the user's hands, by pressure, support themselves. Such projections can also define the basic profile at the back of the grip, as well as its sides. The height, dimensions and shapes of these projections can be varied. In addition, these projections can be individual without forming elongated ribs.

7 Claims, 3 Drawing Sheets

5
3
4
2
3
4
5
1
NORMAL
BIG

FIG. 2
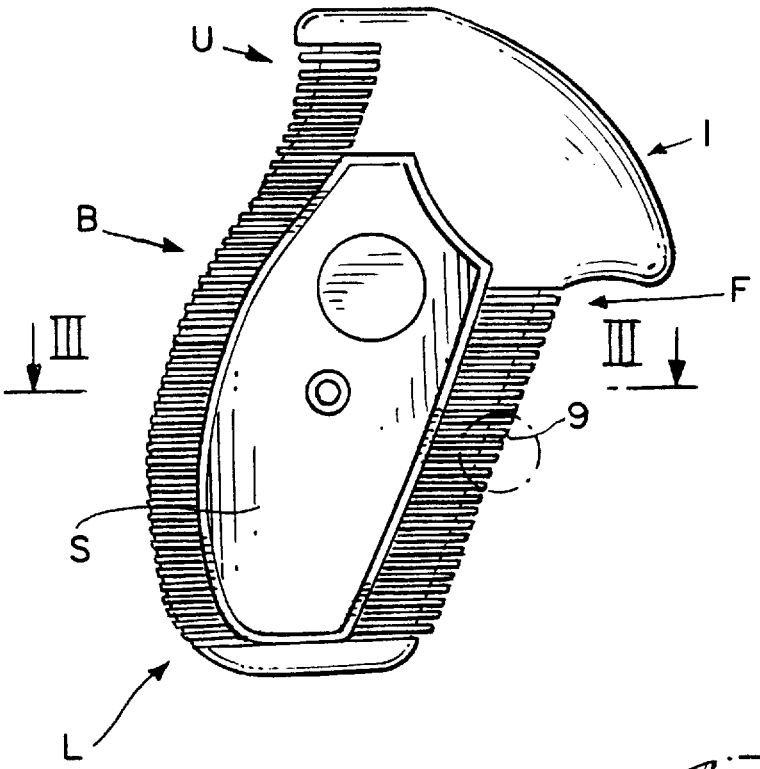
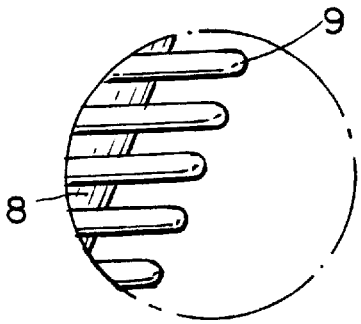
FIG. 4
FIG. 3
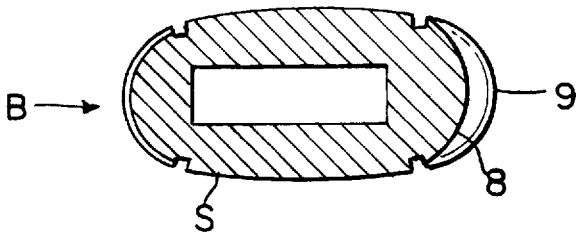

ERGONOMICALLY DEFORMABLE GRIP FOR SPECIAL USE IN FIREARMS

BACKGROUND OF THE INVENTION

The present invention relates to the field of firearm grips and, more particularly, to a deformable grip for special use in firearms, such as revolvers and pistols, intended to provide more comfort, accuracy and control when handling a gun.

In the prior art, there are known grips for revolvers made of rubber or of elastomer, such as those of Santoprene® based upon polypropylene—EPDM, that provide more comfort for a user and, as a result, better control for a user when holding the revolver grip and shooting the revolver. Such comfort results from absorption of the gun's recoil by the grip and from adaptation of the grip to the user's hand as a function of the elasticity of the grip's material. Naturally, the user's shooting control derives from the more comfortable and more consistent way of gripping the gun.

Nevertheless, there are problems with current grip designs, problems that curiously arose from attempts to improve the user's comfort and control when holding the grip and shooting the firearm. These attempts involved providing the front contour of such grips with finger grooves that are intended to seat the middle, ring and little fingers, for example, of the user's hand when the user is gripping the firearm. The mentioned problems originate in the difficulty of adapting the finger grooves to the various shapes of different hands, especially in relation to the fingers, due to the elementary fact, usually ignored, that there is no "average person" for whose hand and fingers such grips would be ideal. As a result, although the grip would be comfortable for some users, many other users are unable to properly and comfortably match their fingers with the finger grooves of the grip, leading to discomfort and decreased shooting control by those users.

It is, therefore, an object of this invention to provide a firearm grip that would be comfortably usable by the widest possible range of users.

It is also an object of this invention to provide a deformable firearm grip that would provide more comfort and shooting control by users with different hand and finger sizes and shapes.

It is a further object of this invention to provide a deformable firearm grip that would provide better absorption and cushioning of the firearm recoil.

SUMMARY OF THE INVENTION

In order to accomplish these objects of the invention and to solve the inconveniences of prior art grips described above, a new ergonomically deformable grip is hereby proposed for special use in revolvers and pistols, the grip being of a type made of a deformable elastomeric material, wherein the front and back contours of the grip are formed by a smooth surface from which projections protrude, the heights of which projections vary in view of the position of each such projection. The projections can be individual or can be elongated so as to form ribs.

BRIEF DESCRIPTION OF THE DRAWINGS

The above and other objects of the present invention will be better understood in consideration of the following detailed description, taken in conjunction with the accompanying attached drawings, which should be seen as merely illustrative and not limiting, in which the reference characters refer to like parts throughout and in which:

FIG. 2 is a side view of the firearm grip of the present invention;

FIG. 3 is a cross-sectional view taken along plane III—III of FIG. 2;

FIG. 4 is an amplified scale view of a detail of FIG. 2;

DETAILED DESCRIPTION OF THE INVENTION

Figure 1:
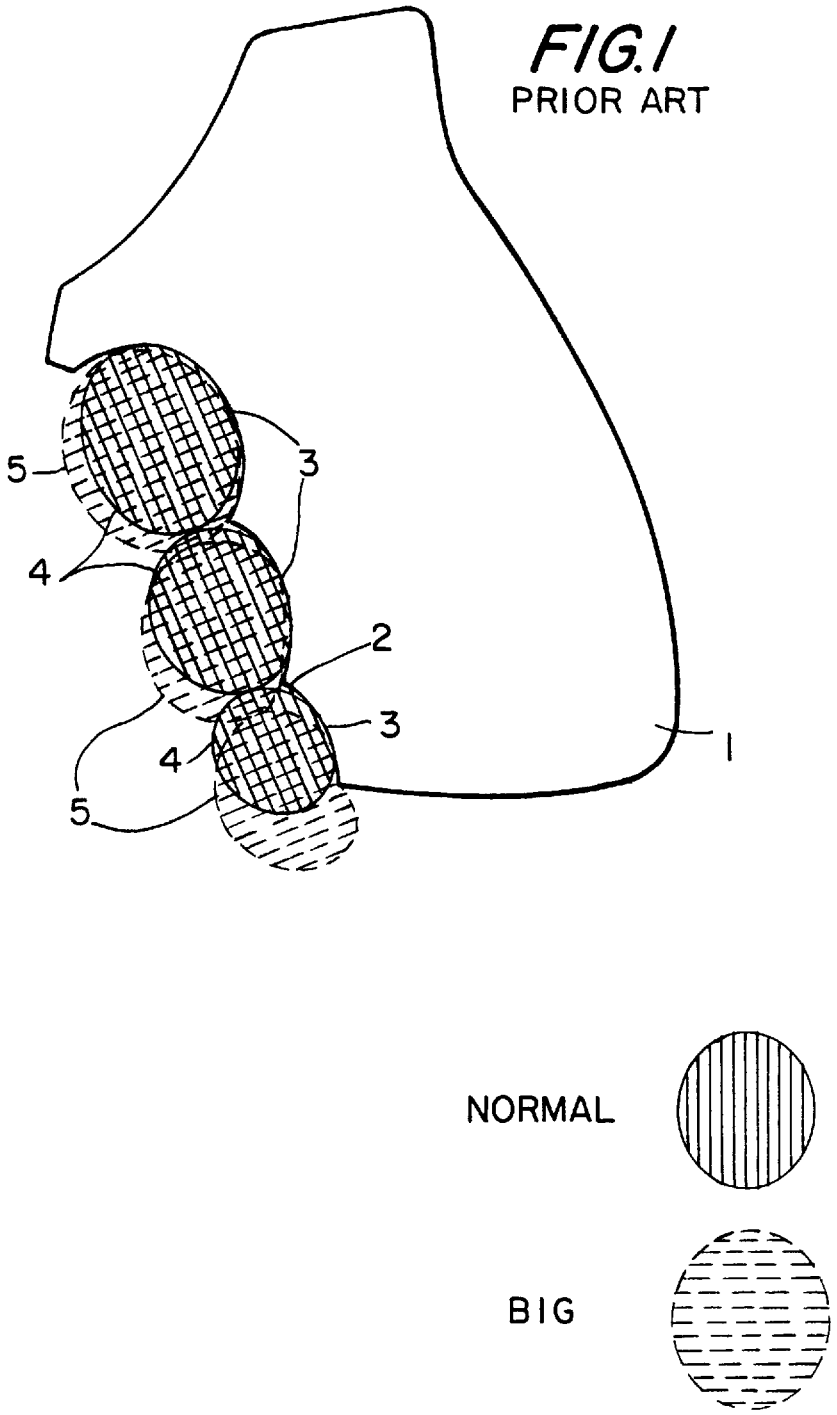
FIG. 1 PRIOR ART
FIG. 1 is a schematic view of the behavior of the fingers of two different users seated on a prior art grip with finger grooves.

Referring now to the drawings, FIG. 1 illustrates schematically the behavior of two types of fingers, "big" and "normal" 4, when a state-of-the-art or known grip 1 having finger grooves 3 formed in its front contour 2 is held by a user. As shown in FIG. 1, the "normal" or average-sized fingers 4 of a user will sit properly within the contours 3 of the front 2 of the grip 1, as intended. However, fingers 5 that are bigger than the normal or average-sized fingers 4 will surpass the appropriate contoured spaces 3 in their resting positions, as shown, while smaller fingers (not shown) will tend to position themselves over the anterior areas of the contours 3. In cases involving other than normal or average-sized fingers 4, therefore, the result is a loss of a good fitting of the gun's grip 1 to the user's hand, which loss compromises the firmness with which the grip is held and the control that the user exercises over the gun.

In order to solve such inconveniences, the grip 1 of the present invention, as shown in FIG. 2, is formed of a deformable elastomeric material having a smooth surface 8 over which uniformly separated parallel ribs 9 protrude. This feature can better be seen in magnification in FIG. 4.

As a special feature, further shown in FIGS. 2 and 3, grip 1 is formed of a smooth-surfaced elastomeric body 8 basically comprising a front portion F on which the user's fingers rest, a back portion B opposed to front portion F on which the heel of the user's hand and the ball of the user's thumb (thenar eminence) are supported, and two side portions S linking front F and back B portions.

In a first embodiment of the present invention, front portion F of grip 1 as well as back portion B of grip 1 are provided with projections 9 in the shape of elongated ribs which are uniformly separated and parallel among themselves. The height of each of these ribs 9 varies according to its position on grip 1. Therefore, for example, the ribs 9 placed in front portion F extend farther from surface 8, i.e., they are "higher", than ribs 9 placed in back portion B, in view of the different deformation requirements supported by each of them.

Furthermore, and in view of the same deformation requirements, back portion B can be divided into two parts, namely upper U and lower L parts, so that ribs 9 in upper part U of back portion B are higher than corresponding ribs 9 of lower part L of back portion B.

In this embodiment of the invention, illustrated in FIGS. 2–4, side portions S of grip 1 are smooth, with no ribs 9 arranged on them.

Figure 5:
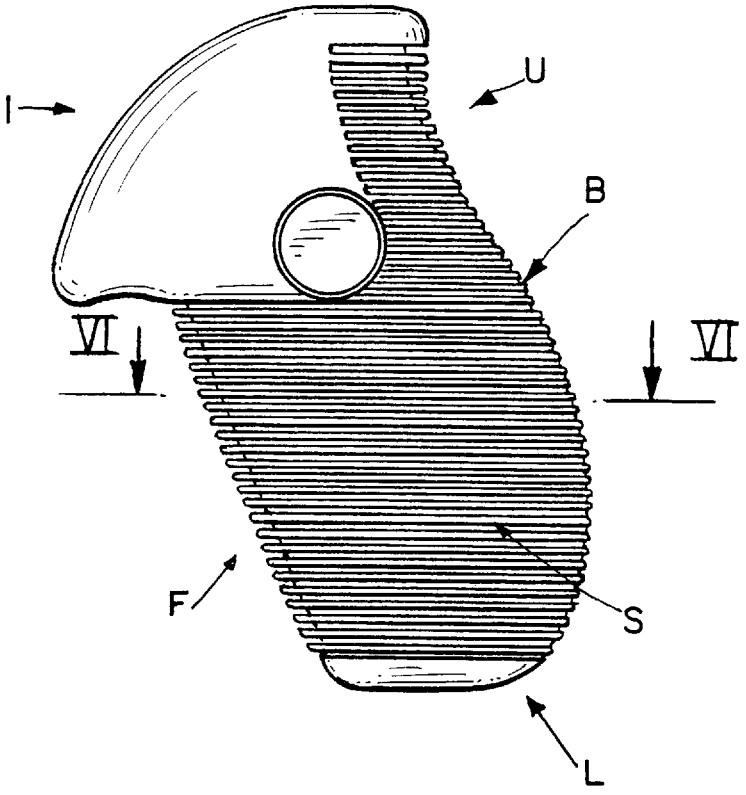
FIG. 5 is a side view of an alternative embodiment of the firearm grip of the present invention.
Figure 6:
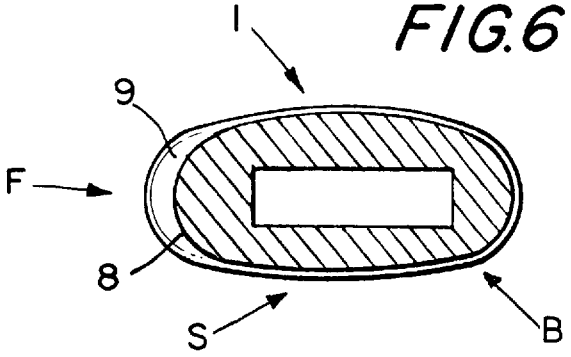
FIG. 6 is a cross-sectional view taken along plane VI—VI of FIG. 5.

In an alternative embodiment, as illustrated in FIGS. 5 and 6, side portions S of the grip 1 are also formed by a smooth elastomeric support surface 8 from which ribs 9 protrude, with the ribs 9 being uniformly separated and parallel among themselves, so as to provide a link between ribs 9 of the front F and back B portions of grip 1. In this case, the heights of the ribs 9 of the side portions S are reduced and are approximately equal to the heights of the ribs 9 arranged on lower part L of back portion B.

Therefore, we notice from the utilization of the grip 1 of the present invention that a better accommodation of the user's fingers is possible at the full length of the grip's front portion F independent of the size of the user's fingers, because the deformation by the grip in order to accommodate the fingers shall be formed by the pressure made by said fingers and, therefore, is always in the most comfortable position possible. Deformation is formed based on the placement of the user's fingers and not by any predetermined finger grooves.

Besides, this arrangement is better than those of the prior art because it has been found that the fingers themselves deform about 6% less when gripping the greatly deformable ribs of this system than when they press on a massive and hard grip as exists in the prior art. The grip of this invention is thus even more comfortable for the user.

The same advantages apply for gripping back portion B which, due to the ribs 9, improve the absorption and cushioning of the impact of recoil upon shooting and, therefore, protect the user's hands and, in particular, the thenar eminence of the user's hand from forceful impact.

Finally, it is also evident that one can vary various features of the grip of this invention without departing from the basic and fundamental concept of the present invention. For example, the generic shapes, the profiles or the dimensions of the ribs, as well as the relative gaps between ribs can be varied from grip to grip or within the same grip without departing from the objects of this invention. In addition, the ribs can be developed with a continuous or segmented construction, as a rib would be if constituted by a row of small projections in the shape of parallelepipeds, pyramids, trunk-cones, ovoids, ellipsoids, spheroids, and others, not represented in the figures.

Furthermore, the principles of the invention are still satisfied by forming the surface of the grip into such small projections of various sizes and shapes such as those identified above that are very close to each other but may not necessarily be in a row and may not form ribs.

Thus, an ergonomically deformable grip for special use in firearms is provided. One skilled in the art will appreciate that the present invention can be practiced by other than the described embodiments, which are presented for purpose of illustration and not limitation, and the present invention is limited only by the claims that follow.

I claim:

1. An ergonomically deformable grip for special use in firearms, said grip comprising a contoured front, a contoured back and two sides joining said front and back, said front, back and sides being formed of a deformable elastomeric material, wherein said contours of said front and back are formed by a smooth surface from which projections protrude, said projections being of heights that vary according to the position on said front, back or sides occupied by said projections.

2. A grip according to claim 1, characterized by the fact that the heights of the projections arranged on said front are larger than the heights of the projections arranged in said back.

3. A grip according to claim 1, wherein said back further comprises a contoured upper part and a contoured lower part, further characterized by the fact that the heights of the projections arranged in said upper part of said back are larger than the heights of the projections arranged in said lower part of said back.

4. A grip according to claim 1, characterized by the fact that said projections extend themselves over said sides.

5. A grip according to claim 1, characterized by the fact that said projections are elongated so as to form ribs.

6. A grip according to claim 5, characterized by the fact that said ribs are substantially parallel to one another.

7. A grip according to claim 1, characterized by the fact that said projections can be of a parallelepiped, pyramid, trunk-cone, ovoid, ellipsoid or spheroid cross-sectional shape, profile or dimension.

* * * * *